US011199205B2

(12) United States Patent
Moriki et al.

(10) Patent No.: US 11,199,205 B2
(45) Date of Patent: Dec. 14, 2021

(54) CONSTRUCTION MACHINE

(71) Applicant: HITACHI CONSTRUCTION MACHINERY CO., LTD., Tokyo (JP)

(72) Inventors: Hidekazu Moriki, Mito (JP); Takaaki Chiba, Kasumigaura (JP); Shinya Imura, Toride (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/961,006

(22) PCT Filed: Jan. 10, 2019

(86) PCT No.: PCT/JP2019/000603
§ 371 (c)(1),
(2) Date: Jul. 9, 2020

(87) PCT Pub. No.: WO2019/139104
PCT Pub. Date: Jul. 18, 2019

(65) Prior Publication Data

US 2021/0071392 A1 Mar. 11, 2021

(30) Foreign Application Priority Data

Jan. 11, 2018 (JP) ..... JP2018-002651

(51) Int. Cl.
*F15B 19/00* (2006.01)
*E02F 9/22* (2006.01)

(52) U.S. Cl.
CPC ..... *F15B 19/002* (2013.01); *E02F 9/2228* (2013.01); *E02F 9/2267* (2013.01); *E02F 9/2275* (2013.01);
(Continued)

(58) Field of Classification Search
CPC ..... F15B 19/002
See application file for complete search history.

(56) References Cited

U.S. PATENT DOCUMENTS 7,997,117 B2 * 8/2011 Zhang ..... F16K 37/0083 73/1.79
9,598,841 B2 * 3/2017 Ikegami ..... E02F 9/2271
(Continued)

FOREIGN PATENT DOCUMENTS

JP 2002-372006 A 12/2002
JP 2003-074296 A 3/2003
(Continued)

OTHER PUBLICATIONS

International Preliminary Report on Patentability dated Jul. 23, 2020, received in corresponding International Application No. PCT/JP2019/0000603.
(Continued)

*Primary Examiner* — Thomas E Lazo
*Assistant Examiner* — Michael Quandt
(74) *Attorney, Agent, or Firm* — Mattingly & Malur, PC

(57) ABSTRACT

An object of the present invention is to provide a construction machine that allows easy and accurate calibration of a pressure sensor and enables accurate control of hydraulic actuators. A controller increases the delivery pressure of a hydraulic pump in a state in which first and second meter-out valves and a second meter-in valve are closed and in which a first meter-in valve is opened, and calibrates a first pressure-calculation map such that a pressure calculated on the basis of the first pressure-calculation map matches a pressure calculated on the basis of a supply-pressure-calculation map, and increases the delivery pressure of the hydraulic pump in a state in which the first and second meter-out valves and the first meter-in valve are closed and in which the second meter-in valve is opened, and calibrates a second pressure-calculation map such that a pressure calculated on the basis of the second pressure-calculation map matches the
(Continued)

pressure calculated on the basis of the supply-pressure-calculation map.

4 Claims, 10 Drawing Sheets

(52) U.S. Cl.
CPC ... *F15B 19/007* (2013.01); *F15B 2211/30575* (2013.01); *F15B 2211/45* (2013.01); *F15B 2211/455* (2013.01); *F15B 2211/46* (2013.01); *F15B 2211/6309* (2013.01); *F15B 2211/6313* (2013.01); *F15B 2211/6355* (2013.01); *F15B 2211/7053* (2013.01); *F15B 2211/855* (2013.01)

(56) References Cited

U.S. PATENT DOCUMENTS

| | | | |
|---|---|---|---|
| 9,658,626 | B2 * | 5/2017 | Rannow ..... F15B 19/005 |
| 2002/0162327 | A1 | 11/2002 | Stephenson et al. |
| 2008/0053191 | A1 | 3/2008 | Yoo et al. |
| 2009/0277243 | A1 | 11/2009 | Zhang et al. |
| 2010/0126339 | A1 | 5/2010 | Kobata |
| 2016/0273194 | A1 | 9/2016 | Ikegami et al. |

FOREIGN PATENT DOCUMENTS

| | | | |
|---|---|---|---|
| JP | 2005-098504 | A | 4/2005 |
| JP | 2007-033137 | A | 2/2007 |
| JP | 2008-267450 | A | 11/2008 |
| JP | 2010-502948 | A | 1/2010 |
| JP | 2011-074933 | A | 4/2011 |
| WO | 2015/129931 | A1 | 9/2015 |

OTHER PUBLICATIONS

International Search Report of PCT/JP2019/000603 dated Apr. 9, 2019.

Chinese Office Action received in corresponding Chinese Application No. 201980005932.6 dated Jul. 23, 2021.

* cited by examiner

FIG. 10

| | METER-IN VALVE | | METER-OUT VALVE | | BLEED-OFF VALVE |
|---|---|---|---|---|---|
| MODE COMMAND | A PORT | B PORT | A PORT | B PORT | |
| M90 | STOPPED | STOPPED | STOPPED | STOPPED | STOPPED |
| M91a | STOPPED | STOPPED | ACTUATED | STOPPED | STOPPED |
| M91b | STOPPED | STOPPED | STOPPED | ACTUATED | STOPPED |
| M92a | ACTUATED | STOPPED | STOPPED | STOPPED | STOPPED |
| M92b | STOPPED | ACTUATED | STOPPED | STOPPED | STOPPED |
| M93a | ACTUATED | STOPPED | STOPPED | STOPPED | ACTUATED |
| M93b | STOPPED | ACTUATED | STOPPED | STOPPED | ACTUATED |

CONSTRUCTION MACHINE

TECHNICAL FIELD

The present invention relates to construction machines such as hydraulic excavators.

BACKGROUND ART

In construction machines (e.g. hydraulic excavators), a hydraulic fluid delivered from a hydraulic pump is caused to flow into a first oil chamber of a hydraulic actuator (meter-in), and then discharged from a second oil chamber of the hydraulic actuator to a tank (meter-out), to thereby operate the hydraulic actuator. The flow rate of the hydraulic fluid flowing into the first oil chamber of the hydraulic actuator is adjusted by a meter-in valve, for example, and the flow rate of the hydraulic fluid discharged from the second oil chamber of the hydraulic actuator to the tank is adjusted by a meter-out valve, for example. The valve bodies of these valves move in accordance with lever operation of an operator. The flow rate passing through a valve is typically determined by the movement amount of the valve body (the opening area of the valve), and the pressure difference across the valve. Accordingly, the flow rate of the hydraulic fluid supplied to and discharged from the hydraulic actuator, that is, the operation velocity of the hydraulic actuator, changes in accordance with lever operation by the operator.

For example, Patent Document 1 intends to provide a simple method of accurately controlling a used section (hydraulic actuator), and discloses a fluid pressure valve configuration including: differential pressure sensors (pressure sensors) for sensing the pressure differences across a first valve configuration (meter-in valve) and a second valve configuration (meter-out valve); and opening sensors (position sensors) for sensing the openings (the opening areas or the movement amounts of the valve bodies) of the first valve configuration and the second valve configuration. In the fluid pressure valve configuration of Patent Document 1, the flow rate passing through the meter-in valve or the meter-out valve is controlled in accordance with the pressure difference across the meter-in valve or the meter-out valve calculated based on a signal from a corresponding one of the pressure sensors, and with the opening of the meter-in valve or the meter-out valve calculated based on a signal from a corresponding one of the opening sensors.

PRIOR ART DOCUMENT

Patent Document

Patent Document 1: JP-2005-98504-A

SUMMARY OF THE INVENTION

Problems to be Solved by the Invention

However, errors of the pressure sensors or the position sensors are not taken into consideration in the fluid pressure valve configuration described in Patent Document 1. That is, in a case where a pressure sensor error occurs, the pressure difference across a valve calculated based on a signal output from the pressure sensor also includes an error. In addition, in a case where a position sensor error occurs, the opening area calculated based on a signal output from the position sensor also includes an error. Accordingly, there is a fear that the flow rate passing through the meter-in valve or the meter-out valve, that is, the operation velocity of the hydraulic actuator, may not be controlled accurately, and therefore, there is a demand for technology that allows easy and accurate calibration of a pressure sensor or a position sensor to improve the sensing precision.

The present invention has been made in view of the problems described above, and an object of the present invention is to provide a construction machine that allows easy and accurate calibration of a pressure sensor or a position sensor and enables accurate control of hydraulic actuators.

Means for Solving the Problems

In order to achieve the object described above, the present invention provides a construction machine including: a hydraulic pump; a supply hydraulic line connected to the hydraulic pump; a tank; a discharge hydraulic line connected to the tank; a hydraulic actuator having a first oil chamber and a second oil chamber; a first-actuator hydraulic line connected to the first oil chamber; a second-actuator hydraulic line connected to the second oil chamber; a first meter-in valve provided on a first connection hydraulic line connecting the supply hydraulic line and the first-actuator hydraulic line; a second meter-in valve provided on a second connection hydraulic line connecting the supply hydraulic line and the second-actuator hydraulic line; a first meter-out valve provided on a third connection hydraulic line connecting the first-actuator hydraulic line and the discharge hydraulic line; a second meter-out valve provided on a fourth connection hydraulic line connecting the second-actuator hydraulic line and the discharge hydraulic line; a bleed-off valve provided on a fifth connection hydraulic line connecting the supply hydraulic line and the discharge hydraulic line; a supply-pressure sensor that senses a delivery pressure of the hydraulic pump; a first-load-pressure sensor that senses a pressure of the first oil chamber; a second-load-pressure sensor that senses a pressure of the second oil chamber; and a controller that controls the first and second meter-in valves, the first and second meter-out valves, and the bleed-off valve in accordance with sensing signals of the first and second-load-pressure sensors, and a sensing signal of the supply-pressure sensor. The controller calculates the delivery pressure of the hydraulic pump from the sensing signal of the supply-pressure sensor on a basis of a supply-pressure-calculation map representing a characteristic of the supply-pressure sensor, calculates the pressure of the first oil chamber from the sensing signal of the first-load-pressure sensor on a basis of a first pressure-calculation map representing a characteristic of the first-load-pressure sensor, and calculates the pressure of the second oil chamber from the sensing signal of the second-load-pressure sensor on a basis of a second pressure-calculation map representing a characteristic of the second-load-pressure sensor. The controller increases the delivery pressure of the hydraulic pump in a state in which the first and second meter-out valves and the second meter-in valve are closed and in which the first meter-in valve is opened, and calibrates the first pressure-calculation map such that the pressure calculated on the basis of the first pressure-calculation map matches the pressure calculated on the basis of the supply-pressure-calculation map, and increases the delivery pressure of the hydraulic pump in a state in which the first and second meter-out valves and the first meter-in valve are closed and in which the second meter-in valve is opened, and calibrates the second pressure-calculation map such that the pressure calculated on the basis of the second pressure-calculation map matches the pressure calculated at the supply-pressure calculating section.

According to the thus-configured present invention, by reducing the rate of flow passing through the first or second meter-in valve by actuating the first or second meter-in valve in a state in which the first and second meter-out valves are closed, at least one of the first pressure-calculation map and the second pressure-calculation map can be calibrated easily and accurately. Thus, the precision of sensing of the differential pressure between the supply-pressure sensor and the first or second-load-pressure sensor is improved, so it becomes possible to accurately control the hydraulic actuator.

Advantages of the Invention

According to the present invention, in construction machines such as hydraulic excavators, it becomes possible to calibrate a pressure sensor easily and accurately to thereby control hydraulic actuators accurately.

BRIEF DESCRIPTION OF THE DRAWINGS

FIG. 10 is a figure illustrating operation of an A-port meter-in valve, a B-port meter-in valve, an A-port meter-out valve, a B-port meter-out valve, a first bleed-off valve and a second bleed-off valve in response to each mode command.

MODES FOR CARRYING OUT THE INVENTION

Figure 1:
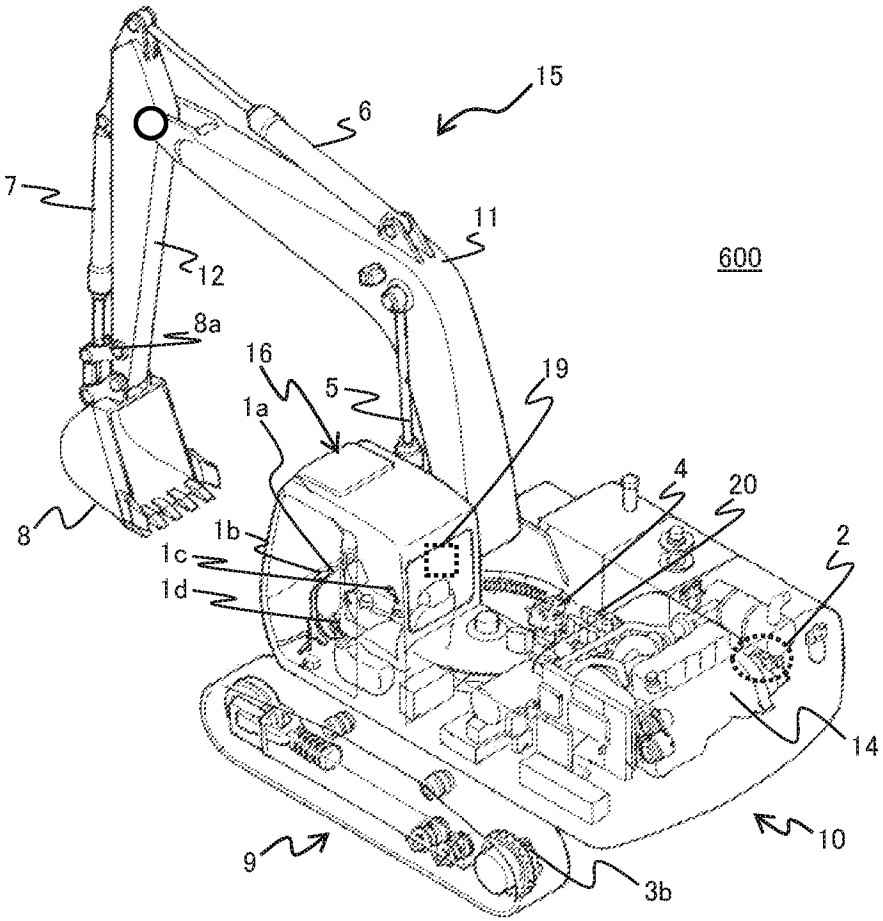
FIG. 1 is a figure schematically illustrating the external appearance of a hydraulic excavator which is one example of construction machines according to an embodiment of the present invention.

Hereinafter, an embodiment of the present invention is explained with reference to the drawings. Note that equivalent members are given identical reference characters through the drawings, and overlapping explanations are omitted as appropriate.

FIG. 1 is a figure schematically illustrating the external appearance of a hydraulic excavator as one example of construction machines according to the present embodiment.

In FIG. 1, a hydraulic excavator 600 includes: an articulated-type front implement (front work implement) 15 including a plurality of interconnected driven members (a boom 11, an arm 12 and a bucket (work device) 8) that individually pivot vertically; and an upper swing structure 10 and a lower track structure 9 that constitute at least part of the machine-body. The upper swing structure 10 is swingably provided to the lower track structure 9. In addition, the base end of the boom 11 of the front implement 15 is vertically pivotably supported at a front portion of the upper swing structure 10, one end of the arm 12 is vertically pivotably supported at an end portion (tip) of the boom 11 which is different from the base end, and the bucket 8 is vertically pivotably supported at the other end of the arm 12 via a bucket link 8*a*. The boom 11, the arm 12, the bucket 8, the upper swing structure 10 and the lower track structure 9 are driven by a boom cylinder 5, an arm cylinder 6, a bucket cylinder 7, a swing hydraulic motor 4 and left and right traveling hydraulic motors 3*b* (only one traveling hydraulic motor is illustrated) which are hydraulic actuators, respectively.

In a cab 16 on which an operator gets, a right operation lever device 1*c* and a left operation lever device 1*d* which are operation levers (operation devices) that output operation signals for operating the hydraulic actuators 5 to 7 of the front implement 15, and the swing hydraulic motor 4 of the upper swing structure 10, and a travel right operation lever device 1*a* and a travel left operation lever device 1*b* that output operation signals for operating the left and right traveling hydraulic motors 3*b* of the lower track structure 9 are provided.

The left and right operation lever devices 1*c* and 1*d* are each an electric operation lever device that outputs an electric signal as an operation signal, and has an operation lever operated to be inclined forward, backward, leftward and rightward by the operator, and an electric signal generating section that generates an electric signal according to the inclination direction and the inclination amount (lever operation amount) of the operation lever. Electric signals output from the operation lever devices 1*c* and 1*d* are input to a controller 100 (illustrated in FIG. 2) via electric wires. In the present embodiment, operation of the operation lever of the right operation lever device 1*c* in the forward and backward directions corresponds to operation of the boom cylinder 5, and operation of the same operation lever in the leftward and rightward directions corresponds to operation of the bucket cylinder 7. On the other hand, operation of the operation lever of the left operation lever device 1*c* in the forward and backward directions corresponds to operation of the swing hydraulic motor 4, and operation of the same operation lever in the leftward and rightward directions corresponds to operation of the arm cylinder 6.

Operation control of the boom cylinder 5, the arm cylinder 6, the bucket cylinder 7, the swing hydraulic motor 4 and the left and right traveling hydraulic motors 3*b* is performed by control, by means of a control valve 20, of the direction and flow rate of a hydraulic operating fluid supplied from a hydraulic pump apparatus 2 driven by a prime mover (an engine 14 in the present embodiment) such as an engine or an electric motor to the individual hydraulic actuators 3*b* and 4 to 7.

The control valve 20 is driven by a drive signal (pilot pressure) output from a pilot pump, which is not illustrated, via a pilot valve and a solenoid proportional valve. By the pilot pressure being output from the pilot valve to the control valve 20 in conjunction with operation of the travel right operation lever device 1*a* and the travel left operation lever device 1*b*, operation of the left and right traveling hydraulic motors 3*b* of the lower track structure 9 is controlled. In addition, by the solenoid proportional valve being controlled by the controller 100 on the basis of operation signals output from the operation lever devices 1*c* and 1*d*, operation of the individual hydraulic actuators 3*b* and 4 to 7 is controlled. The boom 11 pivots in the upward and downward directions relative to the upper swing structure 10 due to extension and contraction of the boom cylinder 5, the arm 12 pivots in the upward and downward directions and the forward and backward directions relative to the boom 11 due to extension and contraction of the arm cylinder 6, and the bucket 8 pivots in the upward and downward directions and the forward and backward directions relative to the arm 12 due to extension and contraction of the bucket cylinder 7.

Figure 2:
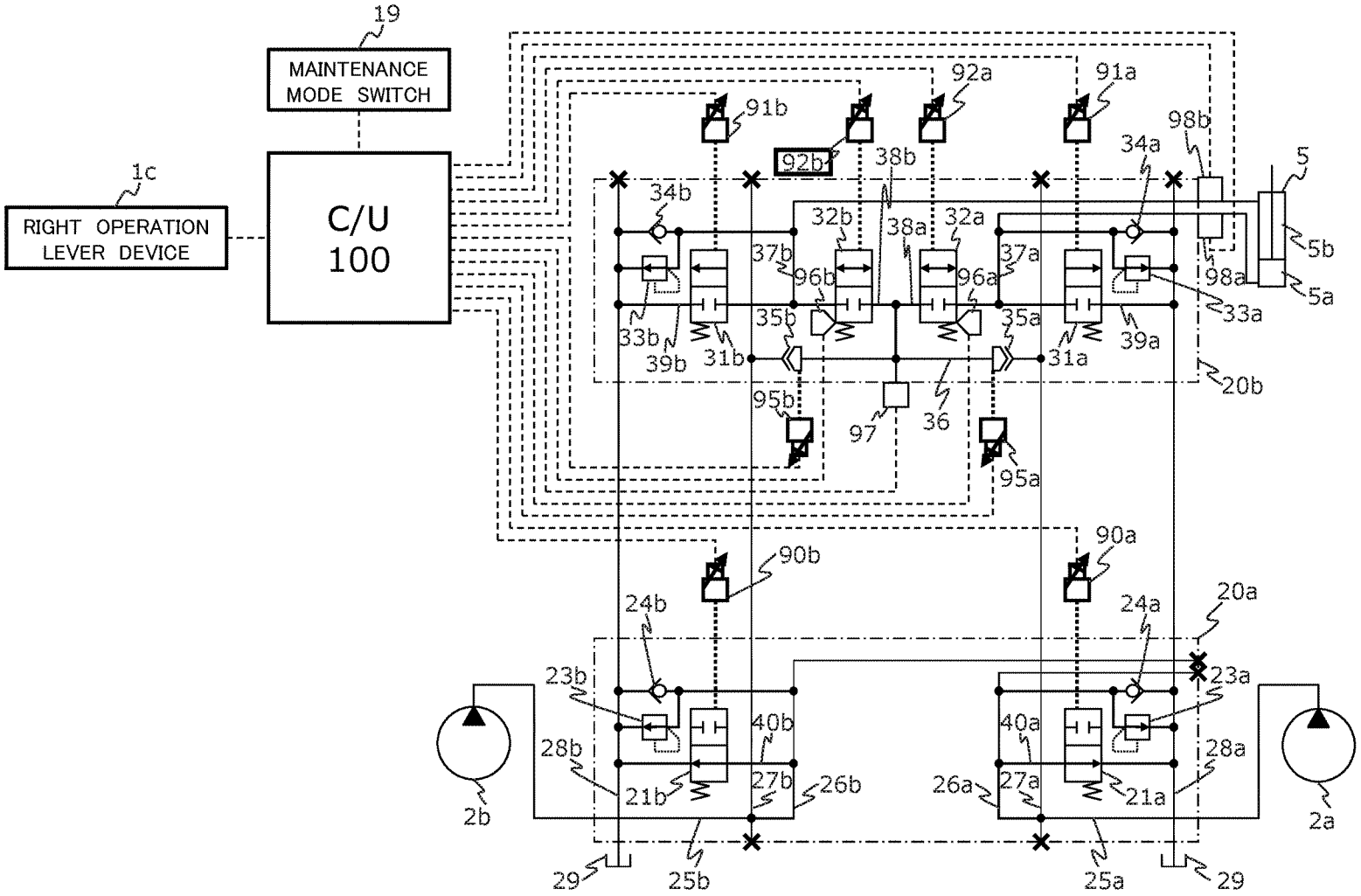
FIG. 2 is a figure schematically illustrating a hydraulic-actuator control system mounted on the hydraulic excavator.

FIG. 2 is a figure schematically illustrating a hydraulic-actuator control system mounted on the hydraulic excavator 600.

In FIG. 2, the hydraulic-actuator control system includes the controller 100 as a control device for controlling operation of the hydraulic excavator 600, and the control valve 20 that drives the boom cylinder 5. Note that in order to simplify the explanation, only a bleed-off section 20*a* and a boom section 20*b* of the control valve 20 are described and explained in FIG. 2, and description and explanation of other sections are omitted. In addition, similarly, in FIG. 3 also, the content related to the bleed-off section and the boom section is described and explained, and description and explanation of other sections are omitted.

The bleed-off section 20*a* of the control valve 20 is provided with a supply hydraulic line 25*a* (25*b*), and is supplied with a hydraulic fluid from the first hydraulic pump 2*a* (second hydraulic pump 2*b*). The supply hydraulic line 25*a* (25*b*) branches into a supply hydraulic line 26*a* (27*a*) and a supply hydraulic line 26*b* (27*b*), the supply hydraulic line 26*a* (26*b*) is connected to a discharge hydraulic line 28*a* (28*b*) via a first bleed-off valve 21*a* (second bleed-off valve 21*b*), a main relief valve 23*a* (23*b*), and a makeup valve 24*a* (24*b*), and the discharge hydraulic line 28*a* (28*b*) is connected to a tank 29. The first bleed-off valve 21*a* (second bleed-off valve 21*b*) is driven by a first bleed-off solenoid valve 90*a* (second bleed-off solenoid valve 90*b*), establishes communication between the supply hydraulic line 26*a* (26*b*) and the discharge hydraulic line 28*a* (28*b*), and bleeds off the hydraulic fluid from the first hydraulic pump 2*a* (second hydraulic pump 2*b*). On the other hand, the supply hydraulic line 27*a* (27*b*) is connected to the boom section 20*b*, and supplies the hydraulic fluid from the first hydraulic pump 2*a* (second hydraulic pump 2*b*) to the boom section 20*b*.

In the boom section 20*b*, the supply hydraulic line 27*a* (27*b*) branches into a branch hydraulic line 36, and a communication control valve 35*a* (35*b*) is provided on the branch hydraulic line 36. The communication control valve 35*a* (35*b*) is a check valve that prevents the flow of the hydraulic fluid from the branch hydraulic line 36 into the supply hydraulic line 27*a* (27*b*), and additionally is configured to be driven by a first communication solenoid valve 95*a* (second communication solenoid valve 95*b*) so as to be able to interrupt the flow of the hydraulic fluid from the supply hydraulic line 27*a* (27*b*) to the branch hydraulic line 36. In addition, the branch hydraulic line 36 is connected to an actuator hydraulic line 37*a* (37*b*) via a connection hydraulic line 38*a* (38*b*). On the connection hydraulic line 38*a* (38*b*), an A-port meter-in valve 32*a* (B-port meter-in valve 32*b*) is provided. The actuator hydraulic line 37*a* (37*b*) is connected to a bottom-side oil chamber 5*a* (rod-side oil chamber 5*b*) of the boom cylinder 5, and is connected to the discharge hydraulic line 28*a* (28*b*) via an over-load relief valve 33*a* (33*b*) and a makeup valve 34*a* (34*b*). In addition, the actuator hydraulic line 37*a* (37*b*) is connected to the discharge hydraulic line 28*a* (28*b*) via a connection hydraulic line 39*a* (39*b*). On the connection hydraulic line 39*a* (39*b*), an A-port meter-out valve 31*a* (B-port meter-out valve 31*b*) is provided. Therefore, by driving and thereby opening the A-port meter-in valve 32*a* (B-port meter-in valve 32*b*) by an A-port meter-in solenoid valve 92*a* (B-port meter-in solenoid valve 92*b*), the hydraulic fluid from the first hydraulic pump 2*a* (second hydraulic pump 2*b*) can be supplied to the boom cylinder 5. In addition, by driving and thereby opening the A-port meter-out valve 31*a* (B-port meter-out valve 31*b*) by an A-port meter-out solenoid valve 91*a* (B-port meter-out solenoid valve 91*b*), the hydraulic fluid of the boom cylinder 5 can be discharged to the tank 29 via the discharge hydraulic line 28*a* (28*b*).

The controller 100 receives inputs of a lever operation signal from the right operation lever device 1*c*, a maintenance-mode demand signal from a maintenance mode switch 19, a supply-pressure sensor signal from a supply-pressure sensor (supply-pressure sensor) 97 installed on the branch hydraulic line 36, an A-port pressure sensor signal and a B-port pressure sensor signal from an A-port pressure sensor 98*a* and a B-port pressure sensor 98*b* installed on the actuator hydraulic lines 37*a* and 37*b*, and an A-port meter-in-valve-position sensor signal and a B-port meter-in-valve-position sensor signal from an A-port meter-in-valve-position sensor 96*a* and a B-port meter-in-valve-position sensor 96*b* installed on the A-port meter-in valve 32*a* and the B-port meter-in valve 32*b*. Further, on the basis of these inputs, the controller 100 drives the A-port meter-in solenoid valve 92*a*, the B-port meter-in solenoid valve 92*b*, the A-port meter-out solenoid valve 91*a*, the B-port meter-out solenoid valve 91*b*, the first communication solenoid valve 95*a*, the second communication solenoid valve 95*b*, the first bleed-off solenoid valve 90*a* and the second bleed-off solenoid valve 90*b*.

Here, the controller 100 supports an actuator operation mode for driving actuators such as the boom cylinder 5, and a maintenance mode for performing calibration of the A-port meter-in-valve-position sensor 96*a*, the B-port meter-in-valve-position sensor 96*b*, the A-port pressure sensor 98*a* and the B-port pressure sensor 98*b*. The maintenance mode switch 19 is a switch that outputs an electric signal of instruction for switching the control mode from the actuator operation mode to the maintenance mode, and may be a push switch that is to be operated manually. In addition, the maintenance mode switch 19 may instead be a configuration that outputs a signal for switching the control mode to the maintenance mode from a terminal for maintenance.

Figure 3:
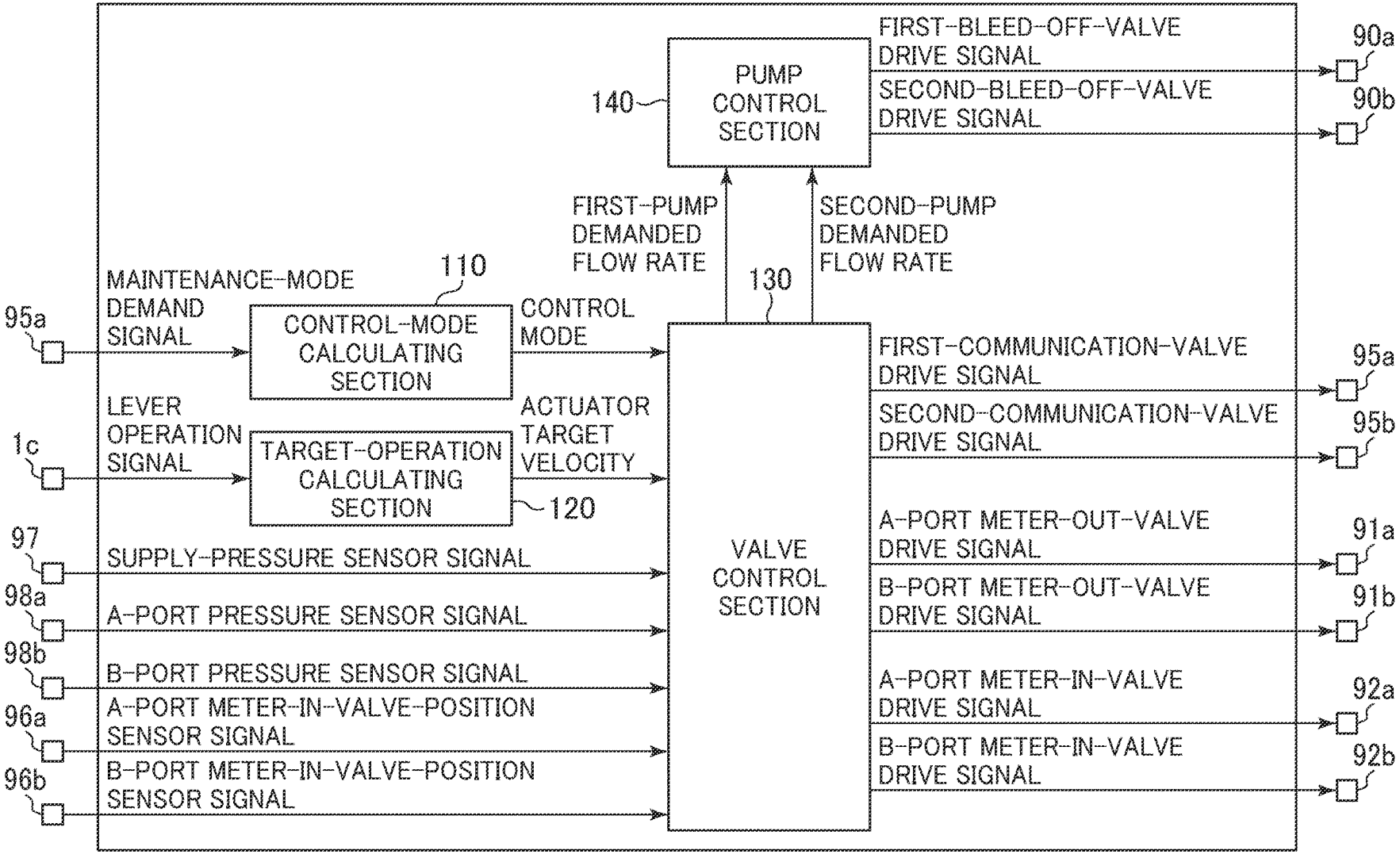
FIG. 3 is a functional block diagram illustrating details of a controller.

FIG. 3 is a functional block diagram illustrating details of the controller 100.

In FIG. 3, the controller 100 has a control-mode calculating section 110, a target-operation calculating section 120, a valve control section 130 and a pump control section 140.

Figure 4:
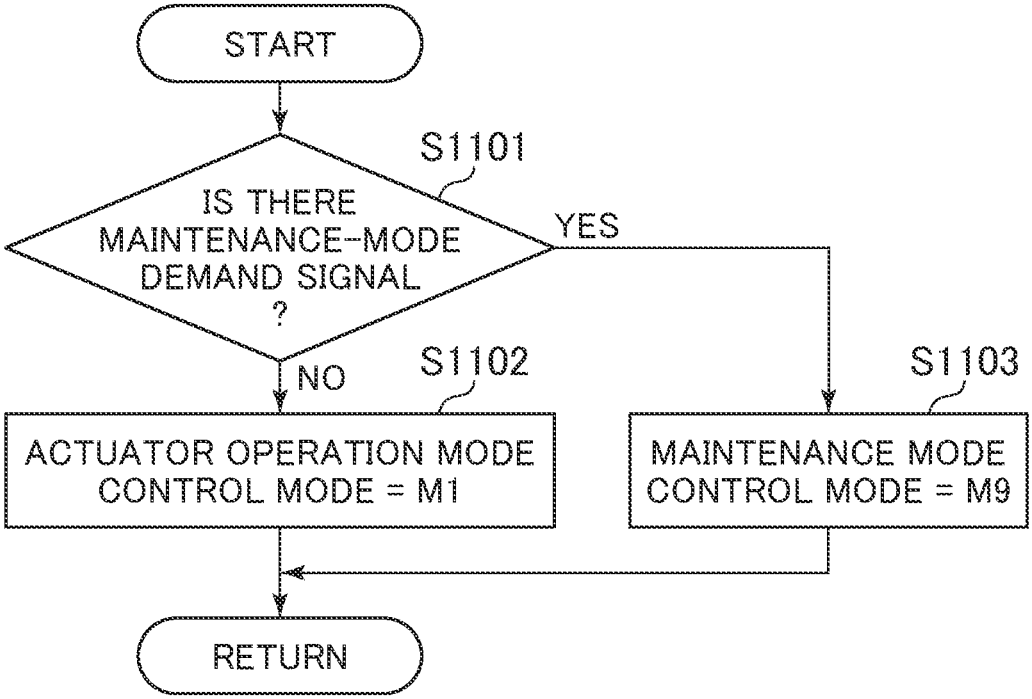
FIG. 4 is a flowchart illustrating a calculation process of a control-mode calculating section.

FIG. 4 is a flowchart illustrating a calculation process of the control-mode calculating section 110. At Step S1101, the control-mode calculating section 110 decides whether or not there is a maintenance-mode demand signal. The control-mode calculating section 110 proceeds to Step S1102 in a case where there are no maintenance-mode demand signals, and proceeds to Step S1103 in a case where there is a maintenance-mode demand signal. At Step S1102, the control mode is set to a control mode M1 representing the actuator operation mode. In addition, at Step S1103, the control mode is set to a control mode M9 representing the maintenance mode. Note that the maintenance mode is further divided into a plurality of control modes, and details thereof are mentioned below.

With reference again to FIG. 3, the target-operation calculating section 120 calculates an actuator target velocity on the basis of a lever operation signal from the right operation lever device 1*c*, and transmits the actuator target velocity to the valve control section 130. For example, as the right operation lever device 1*c* is inclined backward relative to the machine-body increases, the actuator target velocity may be increased positively, and as the right operation lever device 1*c* is inclined forward relative to the machine-body increases, the actuator target velocity may be increased negatively.

On the basis of the control mode from the control-mode calculating section 110, the actuator target velocity from the target-operation calculating section 120, the supply-pressure sensor signal from the supply-pressure sensor 97, the A-port pressure sensor signal and the B-port pressure sensor signal from the A-port pressure sensor 98*a* and the B-port pressure sensor 98*b*, and the A-port meter-in-valve-position sensor signal and the B-port meter-in-valve-position sensor signal from the A-port meter-in-valve-position sensor 96*a* and the B-port meter-in-valve-position sensor 96*b*, respectively, the valve control section 130 calculates a first-pump demanded flow rate and a second-pump demanded flow rate, and outputs the first-pump demanded flow rate and the second-pump demanded flow rate to the pump control section 140. The valve control section 130 additionally calculates a first-communication-valve drive signal, a second-communication-valve drive signal, an A-port meter-out-valve drive signal, a B-port meter-out-valve drive signal, an A-port meter-in-valve drive signal and a B-port meter-in-valve drive signal, and outputs the first-communication-valve drive signal, the second-communication-valve drive signal, the A-port meter-out-valve drive signal, the B-port meter-out-valve drive signal, the A-port meter-in-valve drive signal and the B-port meter-in-valve drive signal to the first communication solenoid valve 95*a*, the second communication solenoid valve 95*b*, the A-port meter-out solenoid valve 91*a*, the B-port meter-out solenoid valve 91*b*, the A-port meter-in solenoid valve 92*a* and the B-port meter-in solenoid valve 92*b*, respectively. Note that the calculations performed by the valve control section 130 vary depending on the control mode, and calculations performed for the actuator operation mode, and calculations performed for the maintenance mode are separately mentioned below in detail.

On the basis of the first-pump demanded flow rate and the second-pump demanded flow rate from the valve control section 130, the pump control section 140 calculates a first-bleed-off-valve drive signal and a second-bleed-off-valve drive signal, and outputs the first-bleed-off-valve drive signal and the second-bleed-off-valve drive signal to the first bleed-off solenoid valve 90*a* and the second bleed-off solenoid valve 90*b*, respectively. For example, the first-bleed-off-valve drive signal (second-bleed-off-valve drive signal) may be calculated such that as the first-pump demanded flow rate (second-pump demanded flow rate) increases, the opening area of the bleed-off valve 21*a* (21*b*) decreases. In addition, the first hydraulic pump 2*a* (second hydraulic pump 2*b*) may be a variable displacement pump, and the delivery flow rate of the first hydraulic pump 2*a* (second hydraulic pump 2*b*) may be controlled on the basis of the first-pump demanded flow rate (second-pump demanded flow rate).

Figure 5:
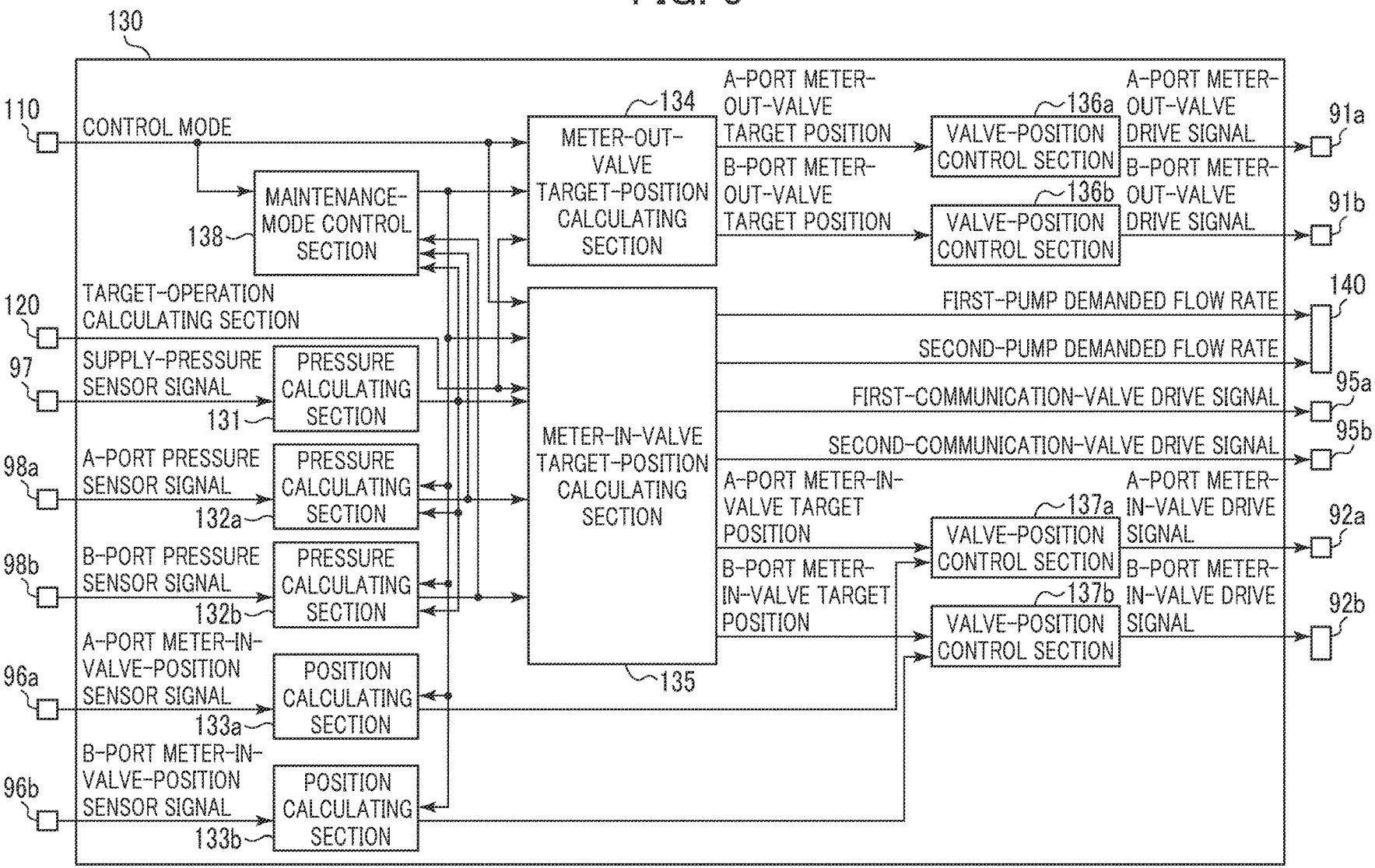
FIG. 5 is a functional block diagram illustrating details of a valve control section.

FIG. 5 is a functional block diagram illustrating details of the valve control section 130.

In FIG. 5, the valve control section 130 has: pressure calculating sections 131, 132*a* and 132*b*; position calculating sections 133*a* and 133*b*; a meter-out-valve target-position calculating section 134; a meter-in-valve target-position calculating section 135; valve-position control sections 136*a*, 136*b*, 137*a* and 137*b*; and a maintenance-mode control section 138.

Hereinafter, processes performed at the valve control section 130 are explained separately for the actuator operation mode and the maintenance mode.

<Actuator Operation Mode>

Processes performed at the valve control section 130 at the time of the actuator operation mode are explained.

Figure 6A:
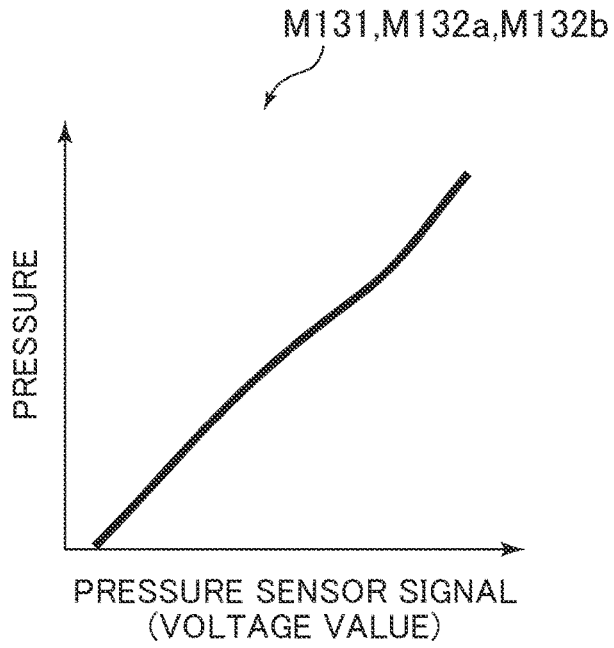
FIG. 6A is a figure illustrating one example of a pressure-calculation map provided to a pressure calculating section.

At the time of the actuator operation mode, the pressure calculating sections 131, 132*a* and 132*b* calculate a supply pressure, an A-port pressure and a B-port pressure on the basis of the supply-pressure sensor signal, the A-port pressure sensor signal and the B-port pressure sensor signal, and outputs the supply pressure, the A-port pressure and the B-port pressure. Specifically, on the basis of a map for calculation (supply-pressure-calculation map) M131 like the one illustrated in FIG. 6A, the pressure calculating section (supply-pressure calculating section) 131 converts the voltage value of the supply-pressure sensor signal into a pressure, and outputs the pressure. Similarly, on the basis of a map for pressure calculation (first pressure-calculation map) M132*a*, the pressure calculating section (first pressure calculating section) 132*a* converts the voltage value of the A-port pressure sensor signal into an A-port pressure, and outputs the A-port pressure. On the basis of a map for pressure calculation (second pressure-calculation map) M132*b*, the pressure calculating section (second pressure calculating section) 132*b* converts the voltage value of the B-port pressure sensor signal into a B-port pressure, and outputs the B-port pressure. Note that the pressure-calculation maps M131, M132*a* and M132*b* are set individually in accordance with the characteristics and/or attachment states of the supply-pressure sensor 97, the A-port pressure sensor 98*a* and the B-port pressure sensor 98*b*.

Figure 6B:
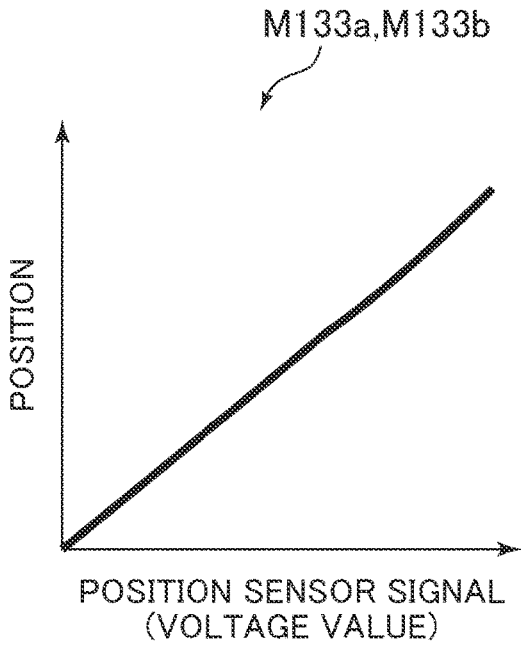
FIG. 6B is a figure illustrating one example of a position-calculation map provided to a position calculating section.

In addition, at the time of the actuator operation mode, on the basis of the A-port meter-in-valve-position sensor signal and the B-port meter-in-valve-position sensor signal, the position calculating sections 133*a* and 133*b*, respectively, calculate an A-port meter-in valve position and a B-port meter-in-valve position, and output the A-port meter-in valve position and the B-port meter-in-valve position. Specifically, on the basis of a position-calculation map (first position-calculation map) M133*a* like the one illustrated in FIG. 6B, the position calculating section (first position calculating section) 133*a* converts the voltage value of the A-port meter-in-valve-position sensor signal into an A-port meter-in valve position, and outputs the A-port meter-in valve position. Similarly, on the basis of a position-calculation map (second position-calculation map) M132*b*, the position calculating section (second position calculating section) 133*b* converts the voltage value of the B-port meter-in-valve-position sensor signal into a valve position, and outputs the valve position.

At the time of the actuator operation mode, on the basis of the actuator target velocity, the meter-out-valve target-position calculating section 134 calculates an A-port meter-out-valve target position and a B-port meter-out-valve target position.

Here, in FIG. 2, an A port of the boom section 20*b* is connected to the bottom-side oil chamber 5*a* of the boom cylinder 5, and a B port of the boom section 20*b* is connected to the rod-side oil chamber 5*b* of the boom cylinder 5. At this time, for example, in a case where the actuator target velocity is a positive velocity, an actuator discharge flow rate is calculated by multiplying the actuator target velocity by the effective area of the rod-side oil chamber 5*b* of the boom cylinder 5, and the B-port meter-out-valve target position is calculated on the basis of the actuator discharge flow rate, and output. In addition, in a case where the actuator target velocity is a negative velocity, the actuator discharge flow rate is calculated by multiplying the actuator target velocity by the effective area of the bottom-side oil chamber 5*a* of the boom cylinder 5, and the A-port meter-out-valve target position is calculated on the basis of the actuator discharge flow rate, and output. These calculations are performed at the meter-out-valve target-position calculating section 134.

At the time of the actuator operation mode, on the basis of the actuator target velocity, the supply pressure, the A-port pressure and the B-port pressure, the meter-in-valve target-position calculating section 135 calculates an A-port meter-in-valve target position, a B-port meter-in-valve target position, the first-pump demanded flow rate, the second-pump demanded flow rate, the first-communication-valve drive signal and the second-communication-valve drive signal.

Here, in FIG. 2, the A port of the boom section 20*b* is connected to the bottom-side oil chamber 5*a* of the boom cylinder 5, and the B port of the boom section 20*b* is connected to the rod-side oil chamber 5*b* of the boom cylinder 5. Accordingly, the bottom side and the rod side of the calculations mentioned before that are performed at the meter-out-valve target-position calculating section 134 are replaced with each other. For example, in a case where the actuator target velocity is a positive velocity, an actuator demanded flow rate is calculated by multiplying the actuator target velocity by the effective area of the bottom-side oil chamber 5*a* of the boom cylinder 5, and the A-port meter-in-valve target position is calculated on the basis of the actuator demanded flow rate and the difference between the supply pressure and the A-port pressure, and output. In addition, in a case where the actuator target velocity is a negative velocity, the actuator demanded flow rate is calculated by multiplying the actuator target velocity by the effective area of the rod-side oil chamber 5*b* of the boom cylinder 5, and the B-port meter-in-valve target position is calculated on the basis of the actuator demanded flow rate and the difference between the supply pressure and the B-port pressure, and output.

In addition, regarding the first-pump demanded flow rate and the second-pump demanded flow rate calculated at the meter-in-valve target-position calculating section 135, for example, in a case where the actuator demanded flow rate is equal to or lower than the flow rate that can be supplied from the first hydraulic pump 2*a*, the first-pump demanded flow rate and the second-pump demanded flow rate may be set to the actuator demanded flow rate and 0, respectively. In addition, in a case where the actuator demanded flow rate is larger than the flow rate that can be supplied from the first hydraulic pump 2*a*, the first-pump demanded flow rate may be set to the maximum flow rate that can be supplied from the first hydraulic pump 2*a*, and the second-pump demanded flow rate may be set to a value obtained by subtracting, from the actuator demanded flow rate, the maximum flow rate that can be supplied from the first hydraulic pump 2*a*. In addition, the first-pump demanded flow rate and the second-pump demanded flow rate may each be set to half of the actuator demanded flow rate, and the manner of allocation to the first-pump demanded flow rate and the second-pump demanded flow rate is not limited to that in the present invention.

In addition, regarding the first-communication-valve drive signal and the second-communication-valve drive signal calculated at the meter-in-valve target-position calculating section 135, for example, if the first-pump demanded flow rate is 0, the first-communication-valve drive signal may be output to close the communication control valve 35*a*, and if the second-pump demanded flow rate is 0, the second-communication-valve drive signal may be output to close the communication control valve 35*b*.

Here, in a case where the load pressure on the actuator is higher than the supply pressure, the hydraulic fluid cannot be caused to flow to the actuator, and the actuator target velocity cannot be attained. That is, in order to surely attain the actuator target velocity, it is necessary to sufficiently increase the supply pressure relative to the load pressure on the actuator. In view of this, the meter-in-valve target-position calculating section 135 corrects the actuator demanded flow rate in accordance with the load pressure, and increases the supply pressure. For example, in a case where the actuator target velocity is a positive (negative) velocity, the meter-in-valve target-position calculating section 135 corrects the actuator demanded flow rate in accordance with the difference between the supply pressure and the A-port pressure (B-port pressure) such that the actuator demanded flow rate increases as the difference decreases, so as to make the supply pressure higher than the A-port pressure (B-port pressure). Thus, the first-pump demanded flow rate and the second-pump demanded flow rate calculated on the basis of the actuator demanded flow rate increase also. As a result, the first-bleed-off-valve drive signal and the second-bleed-off-valve drive signal are calculated at the pump control section 140 such that the opening areas of the first bleed-off valve 21*a* and the second bleed-off valve 21*b* decrease, thus the supply pressure can be increased to thereby surely attain the actuator target velocity. These calculations are performed at the meter-in-valve target-position calculating section 135.

On the basis of the A-port meter-out-valve target position and the B-port meter-out-valve target position, the valve-position control sections 136*a* and 136*b*, respectively, calculate the A-port meter-out-valve drive signal and the B-port meter-out-valve drive signal, and output the A-port meter-out-valve drive signal and the B-port meter-out-valve drive signal.

Similarly, on the basis of the A-port meter-in-valve target position and the B-port meter-in-valve target position, the valve-position control section 137*a* and 137*b*, respectively, calculate the A-port meter-in-valve drive signal and the B-port meter-in-valve drive signal, and output the A-port meter-in-valve drive signal and the B-port meter-in-valve drive signal.

It should be noted however that the valve-position control sections 137*a* and 137*b* also receive inputs of the A-port meter-in valve position and the B-port meter-in-valve position from the position calculating sections 133*a* and 133*b*, and correct the A-port meter-in-valve drive signal and the B-port meter-in-valve drive signal, respectively, in accordance with the deviation between the A-port meter-in-valve target position and the A-port meter-in valve position, and the deviation between the B-port meter-in-valve target position and the B-port meter-in-valve position. Thus, the positions of the A-port meter-in valve and the B-port meter-in valve are controlled accurately.

<Maintenance Mode>

Figure 7:
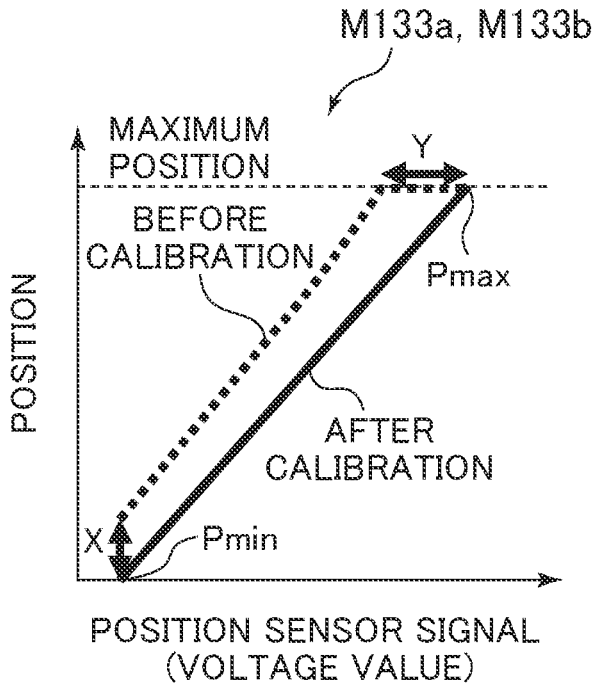
FIG. 7 is a figure illustrating one example of a method of calibrating the position-calculation map.
Figure 8:
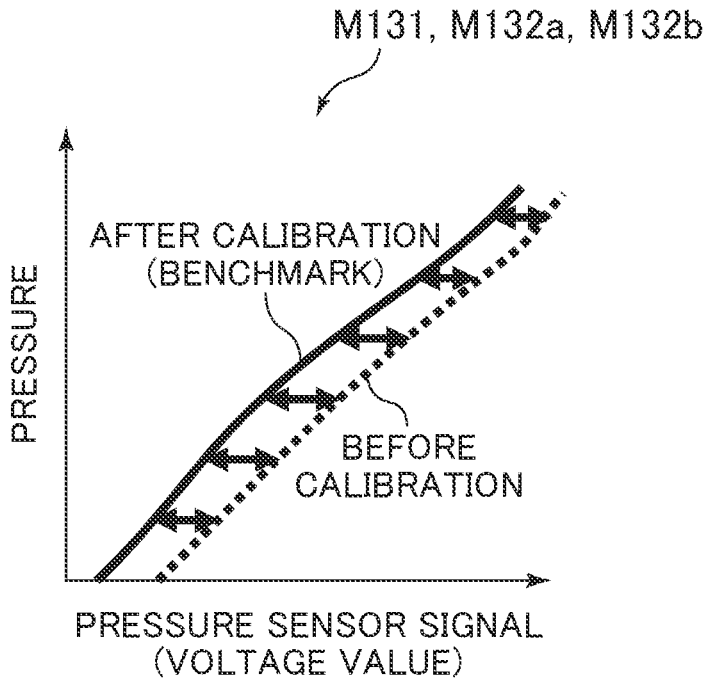
FIG. 8 is a figure illustrating one example of a method of calibrating the pressure-calculation map.

Processes to be performed at the valve control section 130 at the time of the maintenance mode are explained. In order to control the actuator accurately at the time of the actuator operation mode, in the maintenance mode, in accordance with an instruction by the maintenance-mode control section 138, calculation processes of the meter-out-valve target-position calculating section 134 and the meter-in-valve target-position calculating section 135 are performed, and additionally errors of the A-port meter-in-valve-position sensor 96*a*, the B-port meter-in-valve-position sensor 96*b*, the A-port pressure sensor 98*a* and the B-port pressure sensor 98*b* are calibrated. For example, as illustrated in FIG. 7, in a contactless position sensor such as an LVDT, an error (indicated by the arrow X in FIG. 7) is generated in a minimum position due to the misalignment of the attachment position, and an error (indicated by the arrow Y in FIG. 7) is generated in a maximum position due to variation in power-supply voltage resulting from resistance value of power-supply line. Therefore, it is necessary to calibrate the maps M133*a* and M133*b* for calculation provided to the position calculating sections 133*a* and 133*b*, respectively. In addition, as illustrated in FIG. 8, errors are generated in pressure sensor signals of the pressure sensors 97, 98*a* and 98*b* relative to true pressures due to individual variations. Therefore, in order to sense pressure differences accurately, it is necessary to rewrite and calibrate the maps M132*a* and M132*b* for calculation, which are provided to the pressure calculating sections 132*a* and 132*b*, such that outputs of the maps M132*a* and M132*b* match outputs of the supply-pressure sensor 97 which serves as a reference sensor.

The valve control section 130 according to the present embodiment includes the following maintenance-mode control section 138 in order to perform calibration of the position sensors and calibration of the pressure sensors.

Figure 9:
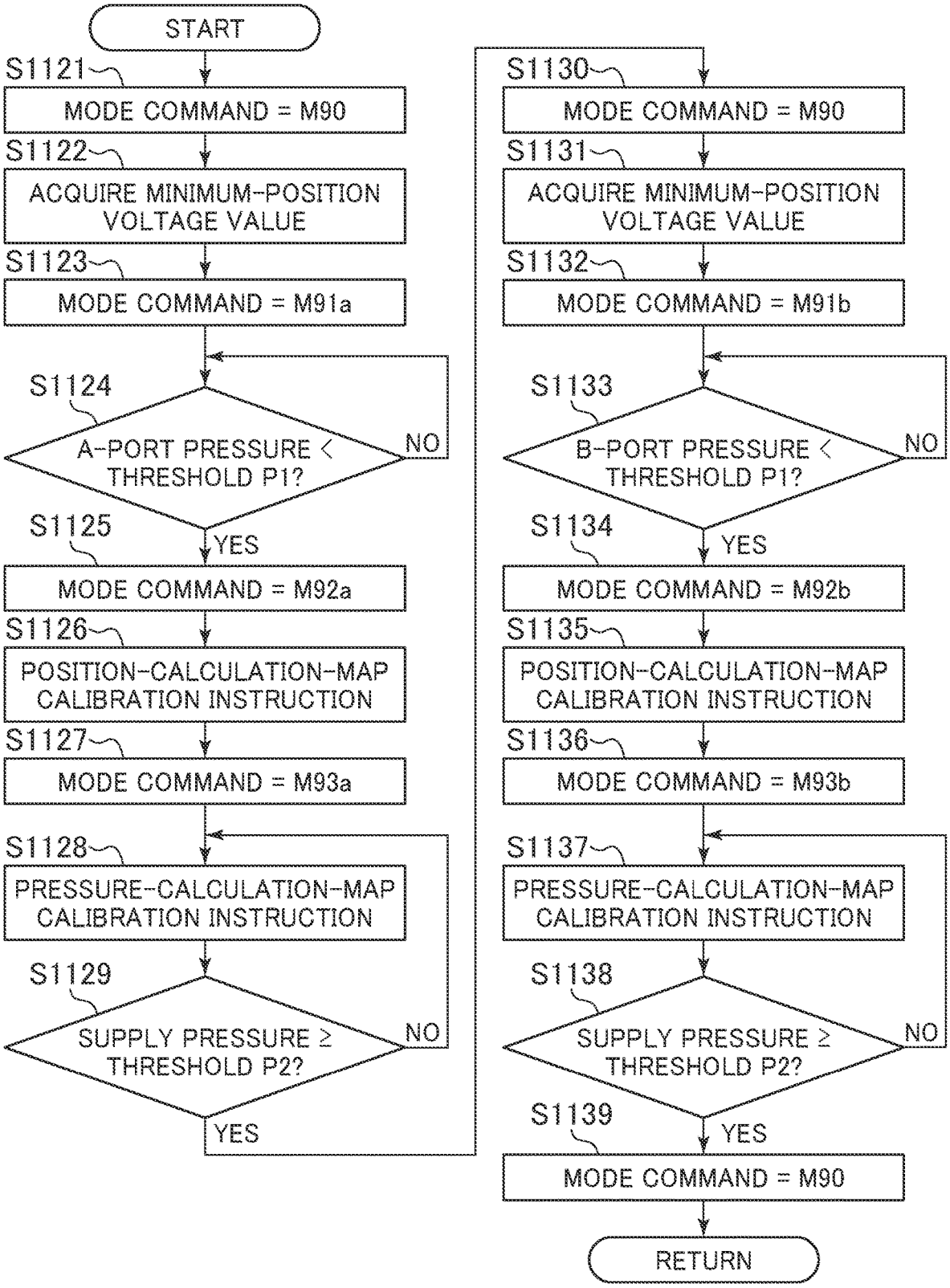
FIG. 9 is a flowchart illustrating a calculation process of a maintenance-mode control section.

FIG. 9 is a flowchart illustrating a calculation process of the maintenance-mode control section 138, and FIG. 10 is a figure illustrating operation of the A-port meter-in valve 32*a*, the B-port meter-in valve 32*b*, the A-port meter-out valve 31*a*, the B-port meter-out valve 31*b*, the first bleed-off valve 21*a* and the second bleed-off valve 21*b*, in response to each mode command.

In FIG. 9, at Step S1121, the control mode is set to M90. The control mode M90 is a stop mode, and a maintenance mode command is output to the meter-out-valve target-position calculating section 134 and the meter-in-valve target-position calculating section 135 such that all of the meter-in valves 32*a* and 32*b*, the meter-out valves 31*a* and 31*b* and the bleed-off valves 21*a* and 21*b* stop at the initial positions. In response to reception of the maintenance mode command, the meter-out-valve target-position calculating section 134 calculates the A-port meter-out-valve target position and the B-port meter-out-valve target position as zero, and the meter-in-valve target-position calculating section 135 calculates the A-port meter-in-valve target position and the B-port meter-in-valve target position as zero. In addition, at the meter-in-valve target-position calculating section 135, the first-pump target flow rate and the second-pump target flow rate are calculated as zero. As a result, as illustrated in FIG. 10, in the control mode M90, all of the A-port meter-in valve 32*a*, the B-port meter-in valve 32*b*, the A-port meter-out valve 31*a*, the B-port meter-out valve 31*b*, the first bleed-off valve 21*a* and the second bleed-off valve 21*b* are stopped at the initial positions.

At Step S1122, the voltage value of the A-port meter-in-valve-position sensor 96*a* is acquired, and stored as a minimum-position voltage value.

At Step S1123, the control mode is set to M91*a*. The control mode M91*a* is a depressurization mode, and a maintenance mode command is output to the meter-out-valve target-position calculating section 134 such that only the meter-out valve 31*a* is actuated, and the pressure of the bottom-side oil chamber 5*a* of the boom cylinder 5 is lowered. In response to reception of the maintenance mode command, the meter-out-valve target-position calculating section 134 calculates the A-port meter-out-valve target position as a value larger than 0. As a result, as illustrated in FIG. 10, the A-port meter-out valve 31*a* is actuated, and the bottom-side oil chamber 5*a* of the boom cylinder 5 communicates with the tank 29 in FIG. 2. Thus, the bottom-side pressure of the boom cylinder 5, that is, the A-port pressure, is lowered.

At Step S1124, it is decided whether or not the A-port pressure is equal to or lower than a threshold P1 (e.g. the atmospheric pressure). If the A-port pressure is equal to or lower than the threshold P1, the process proceeds to Step S1125, and if the A-port pressure is not equal to or lower than the threshold P1, the control mode M91*a* continues.

At Step S1125, the control mode is set to M92*a*. The control mode M92*a* is a maintenance mode for calibrating the A-port meter-in-valve-position sensor 96*a*. The maintenance-mode control section 138 outputs a maintenance mode command to the meter-out-valve target-position calculating section 134 and the meter-in-valve target-position calculating section 135. In response to reception of the maintenance mode command, the meter-in-valve target-position calculating section 135 calculates the A-port meter-in-valve target position as the maximum position. In addition, the meter-in-valve target-position calculating section 135 calculates the first-pump demanded flow rate and the second-pump demanded flow rate still as zero. Furthermore, the meter-out-valve target-position calculating section 134 calculates the A-port meter-out-valve target position as zero. As a result, as illustrated in FIG. 10, the A-port meter-in valve 32*a* is actuated to move to the maximum position, and the A-port meter-out valve 31*a* is stopped at the initial position. In addition, the first bleed-off valve 21*a* and the second bleed-off valve 21*b* remain stopped at the initial positions.

At the subsequent Step S1126, the voltage value of the A-port meter-in-valve-position sensor 96*a* when the A-port meter-in valve 32*a* is at the maximum position is acquired, and stored as a maximum-position voltage value. The maintenance-mode control section 138 further outputs, to the position calculating section 133*a*, the minimum-position voltage value stored at Step S1122, the maximum-position voltage value stored at the current step, and a position-calculation-map calibration instruction. As illustrated in FIG. 7, the position calculating section 133*a* having received the position-calculation-map calibration instruction sets a map linearly complemented between a point Pmin, which is determined by the minimum-position voltage value and the minimum position, and a point Pmax, which is determined by the maximum-position voltage value and the maximum position, as the position-calculation map M133*a* after calibration. At this time, since the pressure acting on the A-port meter-in valve 32*a* is low, and also the flow rate passing through the A-port meter-in valve 32*a* is not generated, the maximum position of the A-port meter-in-valve-position sensor 96*a* can be acquired in a state in which the influence of pressure or hydrodynamic force is kept small. As a result, it becomes possible to precisely calibrate the position-calculation map M133*a*.

At Step S1127, the control mode is set to M93*a*. The control mode M93*a* is a pressure sensor calibration mode, and a maintenance mode command is output to the meter-in-valve target-position calculating section 135 such that the pressure sensors are calibrated while the bleed-off valves are actuated to increase the pressure. The meter-in-valve target-position calculating section 135 calculates the first-pump target flow rate and the second-pump target flow rate such that the first-pump target flow rate and the second-pump target flow rate increase gradually. As a result, as illustrated in FIG. 10, while the A-port meter-out valve 31*a*, the B-port meter-out valve 31*b* and the B-port meter-in valve 32*b* have stopped at the initial positions, and while the A-port meter-in valve 32*a* has been actuated to move to the maximum position, the first bleed-off valve 21*a* and the second bleed-off valve 21*b* are actuated to gradually increase the delivery pressures of the first hydraulic pump 2*a* and the second hydraulic pump 2*b*.

At Step S1128, the maintenance-mode control section 138 outputs a pressure-calculation-map calibration instruction to the position calculating section 133*a*. As illustrated in FIG. 7, the pressure calculating section 132*a* having received the pressure-calculation-map calibration instruction rewrites the position-calculation map M132*a* such that the pressure corresponding to the A-port pressure sensor signal matches the supply pressure calculated at the pressure calculating section 131. At this time, in FIG. 2, the hydraulic fluid delivered from the first hydraulic pump 2*a* and the second hydraulic pump 2*b* passes through the A-port meter-in valve 32*a* to flow into the bottom-side oil chamber 5*a* of the boom cylinder 5. However, since both the A-port meter-out valve 31*a* and the B-port meter-out valve 31*b* are stopped at the initial positions, operation of the boom cylinder 5 is suppressed, both the bottom-side and rod-side pressures of the boom cylinder 5 increase, and the flow rate passing through the A-port meter-in valve 32*a* is reduced. In addition, by installing the supply-pressure sensor 97 on a hydraulic line portion which is of a hydraulic line connecting the first hydraulic pump 2*a* or the second hydraulic pump 2*b*, and the A-port meter-in valve 32*a* or the B-port meter-in valve 32*b*, the hydraulic line portion excluding a hydraulic line portion connecting the first hydraulic pump 2*a* or the second hydraulic pump 2*b*, and the first bleed-off valve 21*a* or the second bleed-off valve 21*b*, the flow rate passing through the passage on which the supply-pressure sensor 97 is installed is reduced also. As a result, pressure loss barely occurs, and the supply pressure and the A-port pressure become nearly equal to each other. Accordingly, on the basis of the supply pressure, the pressure calculating section 132*a* can precisely calibrate the map M132*a* for calculating the A-port pressure from the A-port pressure sensor signal.

At Step S1129, it is decided whether or not the supply pressure is equal to or greater than a threshold P2 (e.g. a relief pressure). If the supply pressure is equal to or greater than the threshold P2, the process proceeds to Step S1130, and if the supply pressure is not equal to or greater than the threshold P2, the control mode M93*a* continues. Thus, at the pressure calculating section 132*a*, the map M132*a* for calculating the A-port pressure from the A-port pressure sensor signal can be calibrated over a wide range on the basis of the supply pressure.

At Step S1130, the control mode is set to the control mode M90 (stop mode) again. Thereafter, processes from Step S1131 to Step S1138, which is similar to the processes from Step S1122 to Step S1129, are performed on the side of the B port, and the control mode is set to the control mode M90 at Step S1139, and then the maintenance mode ends.

As mentioned above, in the present embodiment, there is provided the hydraulic excavator 600 including: the hydraulic pumps 2*a* and 2*b*; the supply hydraulic lines 27*a* and 27*b* connected to the hydraulic pumps 2*a* and 2*b*; the tank 29; the discharge hydraulic lines 28*a* and 28*b* connected to the tank 29; the hydraulic actuator 5 having the first oil chamber 5*a* and the second oil chamber 5*b*; the first-actuator hydraulic line 37*a* connected to the first oil chamber 5*a*; the second-actuator hydraulic line 37*b* connected to the second oil chamber 5*b*; the first meter-in valve 32*a* provided on the first connection hydraulic line 38*a* connecting the supply hydraulic lines 27*a* and 27*b* and the first-actuator hydraulic line 37*a*; the second meter-in valve 32*b* provided on the second connection hydraulic line 38*b* connecting the supply hydraulic lines 27*a* and 27*b* and the second-actuator hydraulic line 37*b*; the first meter-out valve 31*a* provided on the third connection hydraulic line 39*a* connecting the first-actuator hydraulic line 37*a* and the discharge hydraulic lines 28*a* and 28*b*; the second meter-out valve 31*b* provided on the fourth connection hydraulic line 39*b* connecting the second-actuator hydraulic line 37*b* and the discharge hydraulic lines 28*a* and 28*b*; the bleed-off valves 21*a* and 21*b* provided on fifth connection hydraulic lines 40*a* and 40*b* connecting the supply hydraulic lines 27*a* and 27*b* and the discharge hydraulic lines 28*a* and 28*b*; the supply-pressure sensor 97 that senses the delivery pressures of the hydraulic pumps 2*a* and 2*b*; the first-load-pressure sensor 98*a* that senses the pressure of the first oil chamber 5*a*; the second-load-pressure sensor 98*b* that senses the pressure of the second oil chamber 5*b*; and the controller 100 that controls the first and second meter-in valves 32*a* and 32*b*, the first and second meter-out valves 31*a* and 31*b*, and the bleed-off valves 21*a* and 21*b* in accordance with sensing signals of the first and second-load-pressure sensors 98*a* and 98*b*, and a sensing signal of the supply-pressure sensor 97. In the hydraulic excavator 600, the controller 100 calculates the delivery pressures of the hydraulic pumps 2*a* and 2*b* from the sensing signal of the supply-pressure sensor 97 on the basis of the supply-pressure-calculation map M131 representing a characteristic of the supply-pressure sensor 97, calculates the pressure of the first oil chamber 5*a* from the sensing signal of the first-load-pressure sensor 98*a* on the basis of the first pressure-calculation map M132*a* representing a characteristic of the first-load-pressure sensor 98*a*, and calculates the pressure of the second oil chamber 5*b* from the sensing signal of the second-load-pressure sensor 98*b* on the basis of the second pressure-calculation map M132*b* representing a characteristic of the second-load-pressure sensor 98*b*. Further, the controller 100 closes the bleed-off valves 21*a* and 21*b* (increases the delivery pressures of the hydraulic pumps 2*a* and 2*b*) in a state in which the first and second meter-out valves 31*a* and 31*b* and the second meter-in valve 32*b* are closed and in which the first meter-in valve 32*a* is opened, and calibrates the first pressure-calculation map M132*a* such that the pressure calculated on the basis of the first pressure-calculation map M132*a* matches the pressure calculated on the basis of the supply-pressure-calculation map M131. Furthermore, the controller 100 closes the bleed-off valves 21*a* and 21*b* (increases the delivery pressures of the hydraulic pumps 2*a* and 2*b*) in a state in which the first and second meter-out valves 31*a* and 31*b* and the first meter-in valve 32*a* are closed and in which the second meter-in valve 32*b* is opened, and calibrates the second pressure-calculation map M132*b* such that the pressure calculated on the basis of the second pressure-calculation map M132*b* matches the pressure calculated on the basis of the supply-pressure-calculation map M131.

In addition, the hydraulic excavator 600 according to the present embodiment further includes: the first-valve-position sensor 96*a* that senses the valve position of the first meter-in valve 32*a*; and the second-valve-position sensor 96*b* that senses the valve position of the second meter-in valve 32*b*. The controller 100 calculates the valve position of the first meter-in valve 32*a* from a sensing signal of the first-valve-position sensor 96*a* on the basis of the first position-calculation map M133*a* representing a characteristic of the first-valve-position sensor 96*a*, and calculates the valve position of the second meter-in valve 32*b* from a sensing signal of the second-valve-position sensor 96*b* on the basis of the second position-calculation map M133*b* representing a characteristic of the second-valve-position sensor 96*b*. The controller 100 actuates the first meter-in valve 32*a* in a state in which the first and second meter-out valves 31*a* and 31*b* and the second meter-in valve 32*b* are closed, and calibrates the first position-calculation map M133*a* such that the valve position calculated on the basis of the first position-calculation map M133*a* when the first meter-in valve 32*a* is at the minimum position becomes the minimum position, and the valve position calculated on the basis of the first position-calculation map M133*a* when the first meter-in valve 32*a* is at the maximum position becomes the maximum position. Alternatively, the controller 100 actuates the second meter-in valve 32*b* in a state in which the first and second meter-out valves 31*a* and 31*b* and the first meter-in valve 32*a* are closed, and calibrates the second position-calculation map M133*b* such that the valve position calculated on the basis of the second position-calculation map M133*b* when the second meter-in valve 32*b* is at the minimum position becomes the minimum position, and the valve position calculated on the basis of the second position-calculation map M133*b* when the second meter-in valve 32*b* is at the maximum position becomes the maximum position.

In addition, the controller 100 according to the present embodiment actuates the bleed-off valves 21*a* and 21*b* in a state in which the first and second meter-out valves 31*a* and 31*b* and the second meter-in valve 32*b* are closed and in which the first meter-in valve 32*a* is opened, and calibrates the first pressure-calculation map M132*a* such that the pressure calculated on the basis of the first pressure-calculation map M132*a* matches the pressure calculated on the basis of the supply-pressure-calculation map M131. Alternatively, the controller 100 according to the present embodiment actuates the bleed-off valves 21*a* and 21*b* in a state in which the first and second meter-out valves 31*a* and 31*b*, and the first meter-in valve 32*a* are closed, and the second meter-in valve 32*b* is opened, and calibrates the second pressure-calculation map M132*b* such that the pressure calculated on the basis of the second pressure-calculation map M132*b* matches the pressure calculated on the basis of the supply-pressure-calculation map M131.

According to the hydraulic excavator 600 according to the present embodiment, the A-port meter-in valve (first meter-in valve) 32*a* or the B port meter-in (second meter-in valve) valve 32*b* is actuated in a state in which the A-port meter-out valve (first meter-out valve) 31*a* and the B-port meter-out valve (second meter-out valve) 31*b* are closed, and at least one of the A-port pressure-calculation map (first pressure-calculation map) M132*a*, the B-port pressure-calculation map (second pressure-calculation map) M132*b*, the A-port position-calculation map (first position-calculation map) M133*a*, and the A-port position-calculation map (second position-calculation map) M133*b* can be calibrated easily and accurately. Thus, the precision of sensing by the A-port meter-in-valve-position sensor (first-valve-position sensor) 96*a* or the B-port meter-in-valve-position sensor (second-valve-position sensor) 96*b* or the precision of sensing of the differential pressure between the supply-pressure sensor (supply-pressure sensor) 97 and the A-port pressure sensor (first-load-pressure sensor) 98*a* or the B-port pressure sensor (second-load-pressure sensor) 98*b* is improved. Accordingly, it becomes possible to accurately control the boom cylinder (hydraulic actuator) 5.

Note that although, in the present embodiment, the bleed-off valves 21*a* and 21*b* are actuated to gradually increase the delivery pressures of the first hydraulic pump 2*a* and the second hydraulic pump 2*b* to thereby calibrate the pressure-calculation map M132*a* such that the pressure calculated at the pressure calculating section 132*a* matches the supply pressure calculated at the pressure calculating section 131 over a wide range of the delivery pressures of the first hydraulic pump 2*a* and the second hydraulic pump 2*b*, the maps M132*a* and M132*b* may be calibrated without actuating the bleed-off valves 21*a* and 21*b*, by calculating the differential pressure between pressures calculated at the pressure calculating sections 132*a* and 132*b* and a pressure calculated at the pressure calculating section 131, at one time point, and then shifting the maps M132*a* and M132*b*, which are maps before being calibrated, by the calculated differential pressure.

Although an embodiment of the present invention has been mentioned in detail thus far, the present invention is not limited to the embodiment described above, but includes various modification examples. For example, although in the embodiment described above, the present invention is applied to a hydraulic excavator including, as a work device, a bucket at the tip of the front work implement, the present invention is not limited to this, but also applicable to hydraulic excavators including work devices other than buckets or construction machines other than hydraulic excavators. In addition, the embodiment described above is explained in detail in order to explain the present invention in an easy-to-understand manner, and the present invention is not necessarily limited to the one including all the configurations explained.

DESCRIPTION OF REFERENCE CHARACTERS

1*a*: Travel right operation lever device
1*b*: Travel left operation lever device
1*c*: Right operation lever device (operation device)
1*d*: Left operation lever device (operation device)
2: Hydraulic pump apparatus
2*a*: First hydraulic pump
2*b*: Second hydraulic pump
3*b*: Traveling hydraulic motor
3*b*: Hydraulic actuator
4: Swing hydraulic motor (hydraulic actuator)
5: Boom cylinder (hydraulic actuator)
5*a*: Bottom-side oil chamber (first oil chamber)
5*b*: Rod-side oil chamber (second oil chamber)
6: Arm cylinder (hydraulic actuator)
7: Bucket cylinder (hydraulic actuator)
8: Bucket (work device)
8*a*: Bucket link
9: Lower track structure
10: Upper swing structure
11: Boom
12: Arm
14: Engine (prime mover)
14: Engine
15: Front implement (front work implement)
16: Cab
19: Maintenance mode switch
20: Control valve
20*a*: Bleed-off section
20*b*: Boom section
21*a*: Bleed-off valve (first bleed-off valve)
21*b*: Bleed-off valve (second bleed-off valve)
23*a*: Main relief valve

23*b*: Main relief valve
24*a*: Makeup valve
24*b*: Makeup valve
25*a*: Supply hydraulic line
25*b*: Supply hydraulic line
26*a*: Supply hydraulic line
26*b*: Supply hydraulic line
27*a*: Supply hydraulic line
27*b*: Supply hydraulic line
28*a*: Discharge hydraulic line
28*b*: Discharge hydraulic line
29: Tank
31*a*: A-port meter-out valve
31*b*: B-port meter-out valve
32*a*: A-port meter-in valve
32*b*: B-port meter-in valve
33*a*: Over-load relief valve
33*b*: Over-load relief valve
34*a*: Makeup valve
34*b*: Makeup valve
35*a*: Communication control valve
35*b*: Communication control valve
36: Branch hydraulic line
37*a*: Actuator hydraulic line (first-actuator hydraulic line)
37*b*: Actuator hydraulic line (second-actuator hydraulic line)
38*a*: Connection hydraulic line (first connection hydraulic line)
38*b*: Connection hydraulic line (second connection hydraulic line)
39*a*: Connection hydraulic line (third connection hydraulic line)
39*b*: Connection hydraulic line (fourth connection hydraulic line)
40*a*: Connection hydraulic line (fifth connection hydraulic line)
40*b*: Connection hydraulic line (fifth connection hydraulic line)
90*a*: First bleed-off solenoid valve
90*b*: Second bleed-off solenoid valve
91*a*: A-port meter-out solenoid valve
91*b*: B-port meter-out solenoid valve
92*a*: A-port meter-in solenoid valve
92*b*: B-port meter-in solenoid valve
95*a*: First communication solenoid valve
95*b*: Second communication solenoid valve
96*a*: A-port meter-in-valve-position sensor (first-valve-position sensor)
96*b*: B-port meter-in-valve-position sensor (second-valve-position sensor)
97: Supply-pressure sensor (supply-pressure sensor)
98*a*: A-port pressure sensor (first-load-pressure sensor)
98*b*: B-port pressure sensor (second-load-pressure sensor)
100: Controller
110: Control-mode calculating section
120: Target-operation calculating section
130: Valve control section
131: Pressure calculating section (supply-pressure calculating section)
132*a*: Pressure calculating section (first pressure calculating section)
132*b*: Pressure calculating section (second pressure calculating section)
133*a*: Position calculating section (first position calculating section)
133*b*: Position calculating section (second position calculating section)
134: Meter-out-valve target-position calculating section
135: Meter-in-valve target-position calculating section
136*a*: Valve-position control section
136*b*: Valve-position control section
137*a*: Valve-position control section
137*b*: Valve-position control section
138: Maintenance-mode control section
140: Pump control section
600: Hydraulic excavator
M131: Supply-pressure-calculation map
M132*a*: A-port pressure-calculation map (first pressure-calculation map)
M132*b*: B-port pressure-calculation map (second pressure-calculation map)
M133*a*: A-port position-calculation map (first position-calculation map)
M133*b*: B-port position-calculation map (second position-calculation map)

The invention claimed is:

1. A construction machine comprising:

a hydraulic pump;

a supply hydraulic line connected to the hydraulic pump;

a tank;

a discharge hydraulic line connected to the tank;

a hydraulic actuator having a first oil chamber and a second oil chamber;

a first-actuator hydraulic line connected to the first oil chamber;

a second-actuator hydraulic line connected to the second oil chamber;

a first meter-in valve provided on a first connection hydraulic line connecting the supply hydraulic line and the first-actuator hydraulic line;

a second meter-in valve provided on a second connection hydraulic line connecting the supply hydraulic line and the second-actuator hydraulic line;

a first meter-out valve provided on a third connection hydraulic line connecting the first-actuator hydraulic line and the discharge hydraulic line;

a second meter-out valve provided on a fourth connection hydraulic line connecting the second-actuator hydraulic line and the discharge hydraulic line;

a bleed-off valve provided on a fifth connection hydraulic line connecting the supply hydraulic line and the discharge hydraulic line;

a supply-pressure sensor that senses a delivery pressure of the hydraulic pump;

a first-load-pressure sensor that senses a pressure of the first oil chamber;

a second-load-pressure sensor that senses a pressure of the second oil chamber; and a controller that controls the first and second meter-in valves, the first and second meter-out valves, and the bleed-off valve in accordance with sensing signals of the first and second-load-pressure sensors, and a sensing signal of the supply-pressure sensor, wherein the controller is configured to:

calculate the delivery pressure of the hydraulic pump from the sensing signal of the supply-pressure sensor on a basis of a supply-pressure-calculation map representing a characteristic of the supply-pressure sensor, calculate the pressure of the first oil chamber from the sensing signal of the first-load-pressure sensor on a basis of a first pressure-calculation map representing a characteristic of the first-load-pressure sensor, calculate the pressure of the second oil chamber from the sensing signal of the second-load-pressure sensor on a basis of a second pressure-calculation map representing a characteristic of the second-load-pressure sensor, increase the delivery pressure of the hydraulic pump in a state in which the first and second meter-out valves and the second meter-in valve are closed and in which the first meter-in valve is opened, and calibrate the first pressure-calculation map such that the pressure of the first oil chamber calculated on the basis of the first pressure-calculation map matches the delivery pressure of the hydraulic pump calculated on the basis of the supply-pressure-calculation map, and increase the delivery pressure of the hydraulic pump in a state in which the first and second meter-out valves and the first meter-in valve are closed and in which the second meter-in valve is opened, and calibrate the second pressure-calculation map such that the pressure of the second oil chamber calculated on the basis of the second pressure-calculation map matches the delivery pressure of the hydraulic pump calculated on the basis of the supply-pressure-calculation map.

2. The construction machine according to claim 1, further comprising:

a first-valve-position sensor that senses a valve position of the first meter-in valve; and a second-valve-position sensor that senses a valve position of the second meter-in valve, wherein the controller is further configured to:

calculate the valve position of the first meter-in valve from a sensing signal of the first-valve-position sensor on a basis of a first position-calculation map representing a characteristic of the first-valve-position sensor, and calculate the valve position of the second meter-in valve from a sensing signal of the second-valve-position sensor on a basis of a second position-calculation map representing a characteristic of the second-valve-position sensor, and the controller is further configured to:

actuate the first meter-in valve in a state in which the first and second meter-out valves and the second meter-in valve are closed, and calibrate the first position-calculation map such that the valve position of the first meter-in valve calculated on the basis of the first position-calculation map when the first meter-in valve is at a minimum position becomes a minimum position, and the valve position of the first meter-in valve calculated on the basis of the first position-calculation map when the first meter-in valve is at a maximum position becomes a maximum position, or actuate the second meter-in valve in a state in which the first and second meter-out valves and the first meter-in valve are closed, and calibrate the second position-calculation map such that the valve position of the second meter-in valve calculated on the basis of the second position-calculation map when the second meter-in valve is at a minimum position becomes a minimum position, and the valve position of the second meter-in valve calculated on the basis of the second position-calculation map when the second meter-in valve is at a maximum position becomes a maximum position.

3. The construction machine according to claim 1, wherein the controller is further configured to:

actuate the bleed-off valve in a state in which the first and second meter-out valves and the second meter-in valve are closed and in which the first meter-in valve is opened, and calibrate the first pressure-calculation map such that the pressure of the first oil chamber calculated on the basis of the first pressure-calculation map matches the delivery pressure of the hydraulic pump calculated on the basis of the supply-pressure-calculation map, or actuate the bleed-off valve in a state in which the first and second meter-out valves and the first meter-in valve are closed and in which the second meter-in valve is opened, and calibrate the second pressure-calculation map such that the pressure of the second oil chamber calculated on the basis of the second pressure-calculation map matches the delivery pressure of the hydraulic pump calculated on the basis of the supply-pressure-calculation map.

4. The construction machine according to claim 1, wherein the supply-pressure sensor is installed on a hydraulic line portion of a hydraulic line connecting the hydraulic pump and the first or second meter-in valve, the hydraulic line portion excluding a hydraulic line portion connecting the hydraulic pump and the bleed-off valve.

* * * * *